United States Patent [19]

Tummino

[11] Patent Number: 4,566,395

[45] Date of Patent: Jan. 28, 1986

[54] SEWING MACHINE NEEDLE THREAD CAPTURING AND SEVERING MECHANISM

[75] Inventor: John Tummino, Maywood, N.J.

[73] Assignee: Clinton Industries, Inc., Carlstadt, N.J.

[21] Appl. No.: 667,990

[22] Filed: Nov. 5, 1984

[51] Int. Cl.[4] ..... D05B 65/02

[52] U.S. Cl. ..... 112/292; 112/184; 112/286

[58] Field of Search ..... 112/286, 292, 184, 285, 112/295

[56] References Cited

U.S. PATENT DOCUMENTS

| | | | |
|---|---|---|---|
| 3,424,116 | 1/1969 | Von Hagen | 112/292 |
| 4,200,050 | 4/1980 | Bianchi | 112/292 |
| 4,385,574 | 5/1983 | Creed et al. | 112/284 |
| 4,455,957 | 1/1984 | Vollmar | 112/292 |

*Primary Examiner*—Werner H. Schroeder
*Assistant Examiner*—Andrew M. Falik
*Attorney, Agent, or Firm*—McAulay, Fields, Fisher, Goldstein & Nissen

[57] ABSTRACT

A sewing machine has a bobbin mechanism, a sewing needle mechanism, and a mechanism capturing and severing bobbin thread comprising a stationary blade, a picker having at least one hook for capturing a bobbin thread and wherein the picker is movable towards the blade to sever the bobbin thread. At least one notch is disposed on the picker for capturing at least one needle thread and is cooperative with the blade for severing the needle thread upon movement of the picker towards the blade.

4 Claims, 5 Drawing Figures

FIG. 4
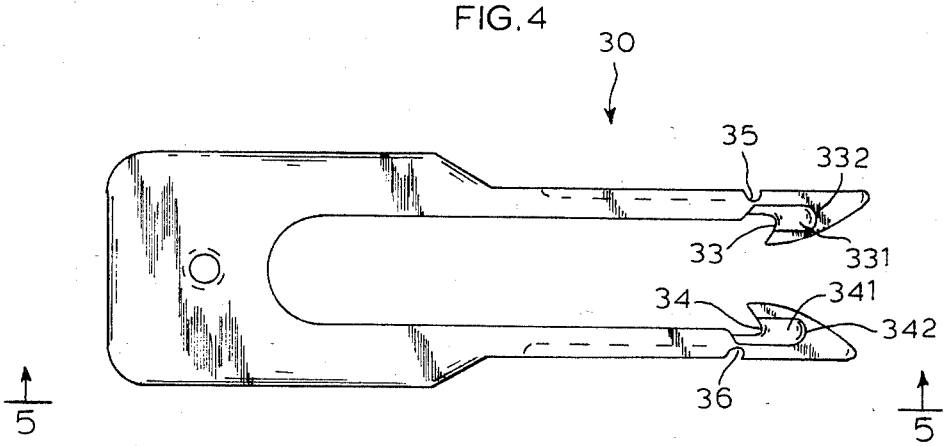
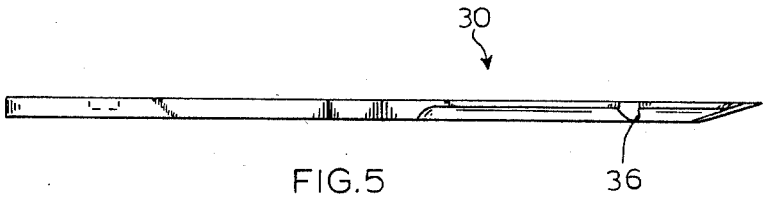
FIG. 5

SEWING MACHINE NEEDLE THREAD CAPTURING AND SEVERING MECHANISM

BACKGROUND OF THE INVENTION

The present invention relates to a sewing machine and in particular to a mechanism for capturing and severing the needle thread during use of the sewing machine.

Present sewing machines utilize a thread wiping apparatus to move a needle thread to a position where it can be severed. The wiping and severing of the needle thread is important to prevent the needle thread and the bobbin thread from becoming tangled.

Conventional sewing machines also have a mechanism for capturing and severing the bobbin thread which works in conjunction with the needle thread severing mechanism.

The bobbin thread capturing and severing mechanism includes a picker which has a forked end in the case of an industrial two needle sewing machine, each forked end having an arrowhead-type of hook which catches the bobbin thread and pulls it towards a stationary blade adjacent to the picker and which acts to sever the bobbin thread by the interaction of the stationary blade and the picker.

SUMMARY OF THE INVENTION

The object of the present invention is to eliminate the need for a separate needle thread wiping and severing mechanism and to effect the capturing and the severing of the needle thread by the use of the same picker mechanism that is used for capturing and severing the bobbin thread.

This and other objects of the present invention are achieved in accordance with the present invention by providing notches on the outside edges of the thread picker and upstream thereof in the direction of movement towards the stationary blade. These notches capture the needle threads which fall into them due to the tension exerted on the threads during normal operation of the machine. As the thread picker moves rearwardly at the end of the sewing operation, the needle threads are severed by the interaction of the picker and the stationary blade adjacent the picker. The bobbin threads are cut just after the needle threads due to the fact that the bobbin threads are captured by the hooks which are slightly downstream of the notches and thus arrive at the stationary blade after the needle threads.

The picker in accordance with the present invention is thus able to effect the capturing the severing of both the needle thread and the bobbin thread and as a result the picker is able to keep both threads in place without the tails thereof flying so that stitches are not lost on the next sewing operation.

The present invention will be described in more detail in the following description with reference to the attached drawings:

BRIEF DESCRIPTION OF THE DRAWINGS

FIG. 4 is a top view of the picker element in accordance with the present invention; and FIG. 5 is a side view of the picker element of FIG. 4.

DETAILED DESCRIPTION OF THE INVENTION

Figure 1:
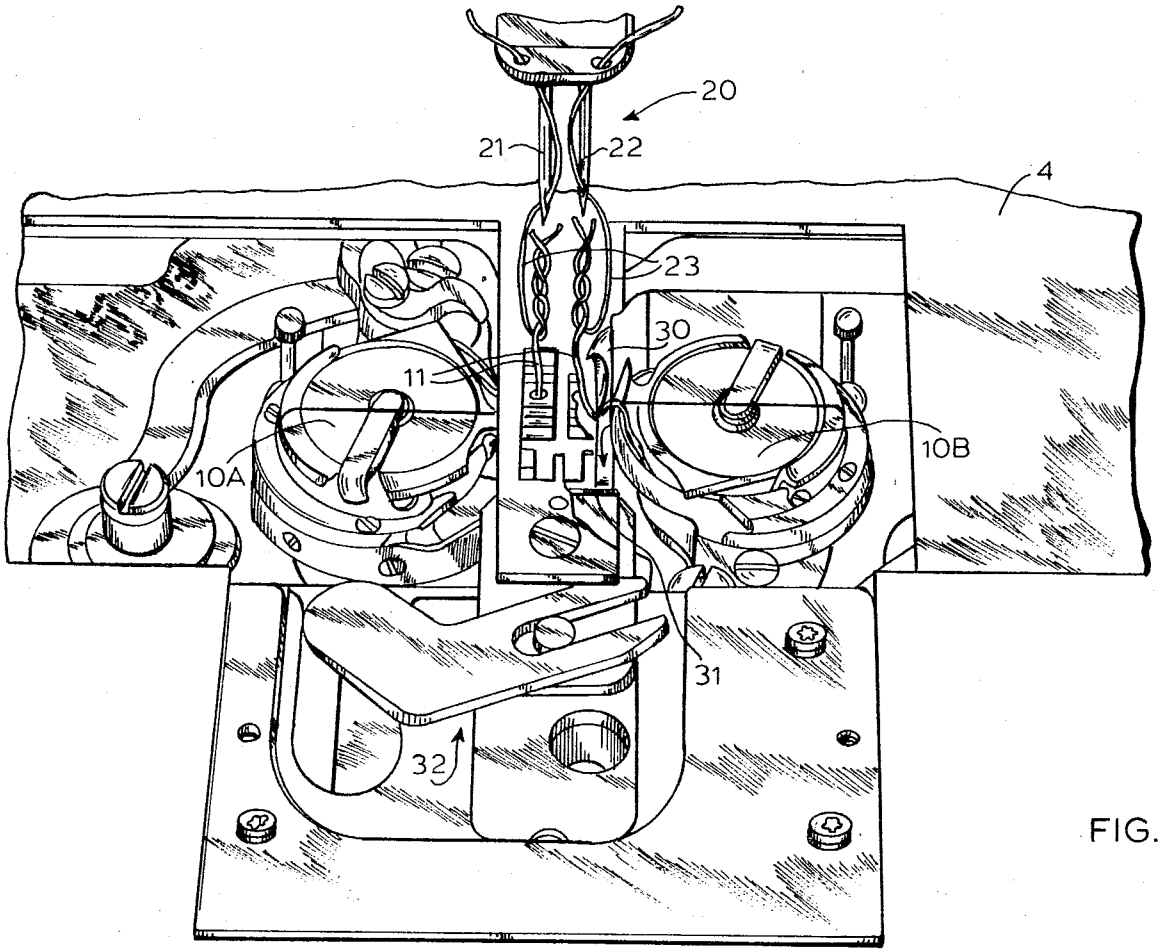
FIG. 1 is a top view of a conventional bobbin thread picker and severing mechanism.

Referring now to FIG. 1, a conventional underbed assembly is shown, as is presently available on Clinton Industries Inc. Sewing Machines Models 1858, 2849 and 2858.

In this conventional mechanism which is for a double needle type machine, the needle assembly 20 is disposed above bed 9 and holds needles 21 and 22 having needle threads 23 extending through the eyes thereof. Under the bed 9, is a bobbin mechanism having two bobbins 10*a* and 10*b* which supply the bobbin thread 11 for each needle.

Also provided in the conventional mechanism is the bobbin thread picker and severer 30 disposed under the bed 9 and thus only one portion thereof is shown though the cutaway view of FIG. 1. Picker 30 is moved from the rest position shown in FIG. 1 to the cutting position in the direction of arrow A towards a stationary knife blade 31 disposed directly thereunder. This movement is effected by the cam mechanism 32. When the picker 30 having the hook at the end thereof captures the bobbin thread 11, it pulls it in direction A until it arrives over blade 31 whereupon the interaction between the blade 31 and the picker 30 severs the thread 11.

Figure 2:
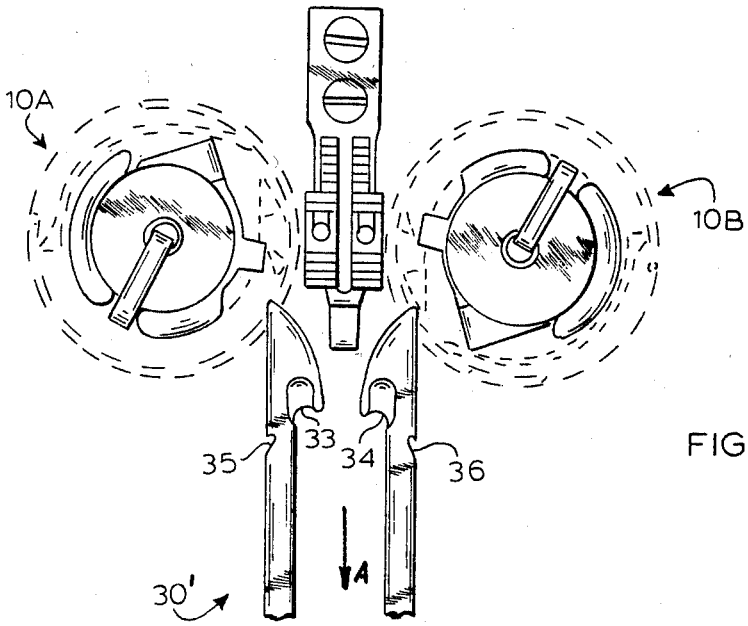
FIG. 2 is a top view of the needle thread capturing and severing mechanism in accordance with the present invention.

FIG. 2 shows the picker 30' in accordance with the present invention, wherein in addition to the hooks 33 and 34 for the bobbin threads, notches 35 and 36 are provided for catching the needle threads and for severing same in conjunction with the stationary blade 31 upon movement of the picker 30' in direction A.

It is noted that the notches 35, 36 are closer to the stationary blade 31 than hooks 33 and 34 and in this way the needle threads are severed prior to the severing of the bobbin threads as is desired in the operation of the sewing machine.

Figure 3:
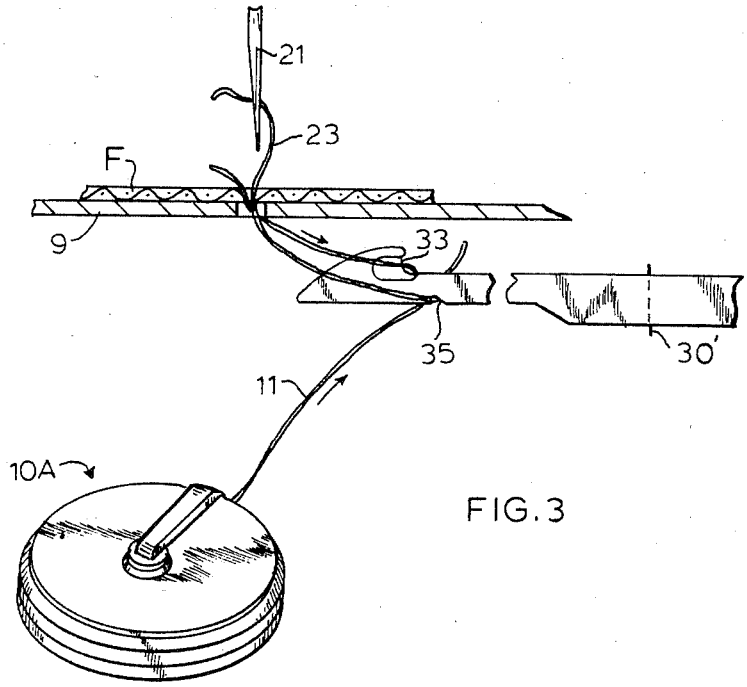
FIG. 3 is a schematic representation of the operation of the present invention.

FIG. 3 shows the manner in which the two threads are captured by the picker 30' during operation. The needle thread which is held under tension in view of the position of needle 21, falls into the notch 35, while bobbin thread 11 is engaged by the hook 33 due to its position prior to the movement of picker 30' in direction A. As the notch 35 and the hook 33 pass the stationary blade edge 31, the threads 11 and 23 will be severed.

FIGS. 4 and 5 illustrate the preferred embodiment of the picker element in accordance with the present invention for use in a two needle sewing machine. It is clear that the device can operate with a single needle sewing machine wherein the picker element will only have one hook and one notch rather than two shown herein.

The picker element is preferably made from a hardened steel and has a thickness of 0.0625", a width of 0.744" and a length of 2.486". The notch 35, 36 is preferably 0.018" from edge 332, 342 of hooks 33, 34. Edges 332, 342 are preceded by depressions 331, 341 which act to capture the bobbin thread, while edges 332, 342 carry out the cutting in conjunction with the blade edge.

It will be appreciated that the instant specification and claims are set forth by way of illustration and not limitation, and that various modifications and changes may be made without departing from the spirit and scope of the present invention.

I claim:

1. In a sewing machine having two bobbins, two sewing needles, and means for capturing and severing bobbin threads comprising a stationary blade, a picker having means forming two hooks for capturing bobbin threads and means for moving the picker towards the blade to sever the bobbin threads, the improvement wherein the means forming the two hooks comprising a fork-shaped portion with two outer straight edges; and further comprising means disposed on the picker for capturing two needle threads and cooperative with the blade for severing the needle threads upon movement of the picker towards the blade, comprising a notch in each straight edge.

2. The improvement according to claim 1, wherein the means forming each hook includes a substantially planar elongated member with the straight outer edge.

3. The improvement according to claim 2, wherein each notch is positioned closer to said blade than said hook.

4. The improvement according to claim 1, wherein said notches are positioned closer to said blade than said hooks.

* * * * *